US006889487B2

(12) United States Patent
Suga

(10) Patent No.: US 6,889,487 B2
(45) Date of Patent: May 10, 2005

(54) APPARATUS FOR CONTINUOUSLY FORMING VACUUM PACKAGED BODY

(75) Inventor: Tadoru Suga, Osaka-Fu (JP)

(73) Assignee: Ibaraki Seiki Machinery Co., Ltd., Osaka-fu (JP)

( * ) Notice: Subject to any disclaimer, the term of this patent is extended or adjusted under 35 U.S.C. 154(b) by 0 days.

(21) Appl. No.: 10/799,067

(22) Filed: Mar. 12, 2004

(65) Prior Publication Data

US 2004/0172924 A1 Sep. 9, 2004

Related U.S. Application Data

(62) Division of application No. 10/034,102, filed on Dec. 27, 2001, now abandoned.

(30) Foreign Application Priority Data

Jan. 4, 2001 (JP) ..... 000119807

(51) Int. Cl.[7] ..... B65B 31/00
(52) U.S. Cl. ..... 53/510; 53/550
(58) Field of Search ..... 53/511, 550, 479, 53/551, 450, 451, 433, 434, 512, 510

(56) References Cited

U.S. PATENT DOCUMENTS 2,387,812 A * 10/1945 Sonneborn et al. ..... 53/433
3,750,472 A * 8/1973 Ducousset ..... 73/861.02
3,995,407 A * 12/1976 Segale et al. ..... 53/511
4,075,818 A * 2/1978 Wright et al. ..... 53/548
4,363,205 A * 12/1982 Hollander, Jr. ..... 53/434
4,541,224 A 9/1985 Mugnai
4,601,159 A 7/1986 Mugnai
4,630,429 A * 12/1986 Christine ..... 53/479
4,706,298 A * 11/1987 Lipes et al. ..... 383/71
4,715,166 A * 12/1987 Kameda ..... 53/550
4,922,686 A * 5/1990 Segota ..... 53/434
4,965,985 A * 10/1990 Masubuchi et al. ..... 53/479
5,653,085 A * 8/1997 Suga ..... 53/75
5,706,635 A * 1/1998 Simmons ..... 53/511
5,755,076 A * 5/1998 Otsuka ..... 53/373.7

* cited by examiner

*Primary Examiner*—Stephen F. Gerrity
(74) *Attorney, Agent, or Firm*—Reising, Ethington, Barnes, Kisselle, PC

(57) ABSTRACT

An apparatus for vacuum packaging a continuous packaged body of the invention is so constructed that a seal bar and a seal table are mounted in the respective skirt parts of seal blocks opposite to each other with a tube film interposed between them, and in the case of nipping the tube film by both seal blocks plural intermittent teeth spot close the tube film on the inner sides of both skirt parts as one points in the transfer direction of a material to be packaged. Simultaneously, in ports of the face of a standing gap formed thin along the outsides of the above intermittent teeth, the tube film is flared by vacuum suction force, and from the section of the tube film cut by forcing a cutting edge in the seal bar into a receiving groove cut in the seal table, the air in the tube film is sucked through the spot closing gap and the receiving groove. By spot closing the tube film by the above intermittent teeth distortion of the film in displacement and suction of the air is restrained, and then the cut end of the tube film is heat sealed by the seal bar and the seal table.

2 Claims, 6 Drawing Sheets

Fig, 1
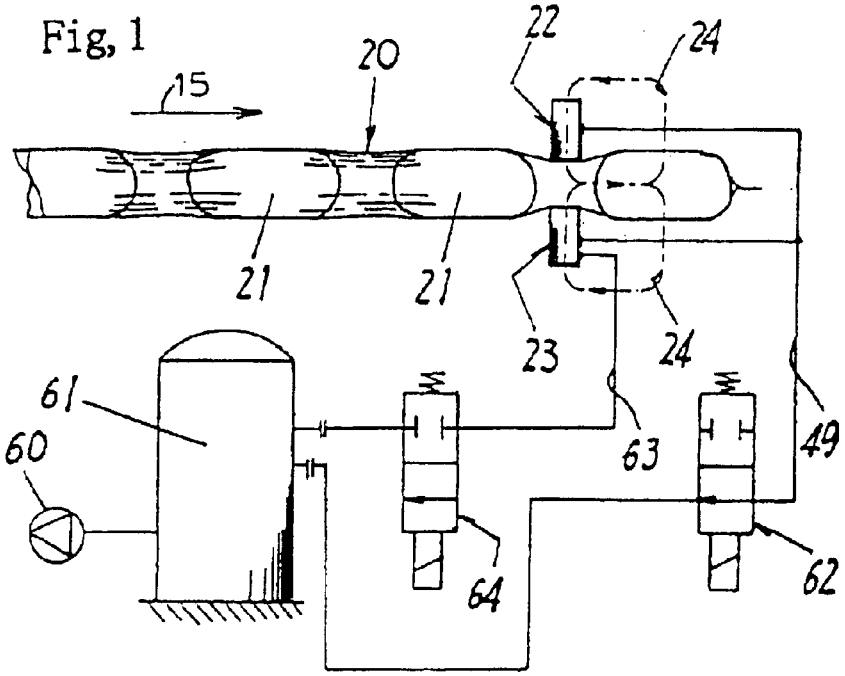
Fig, 4
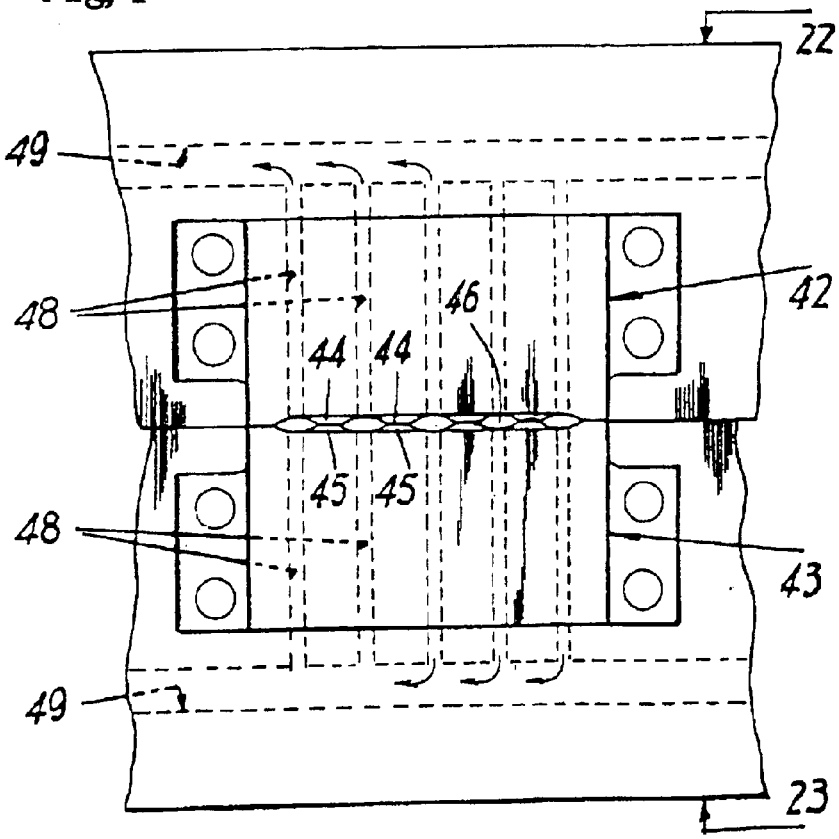

Fig, 2
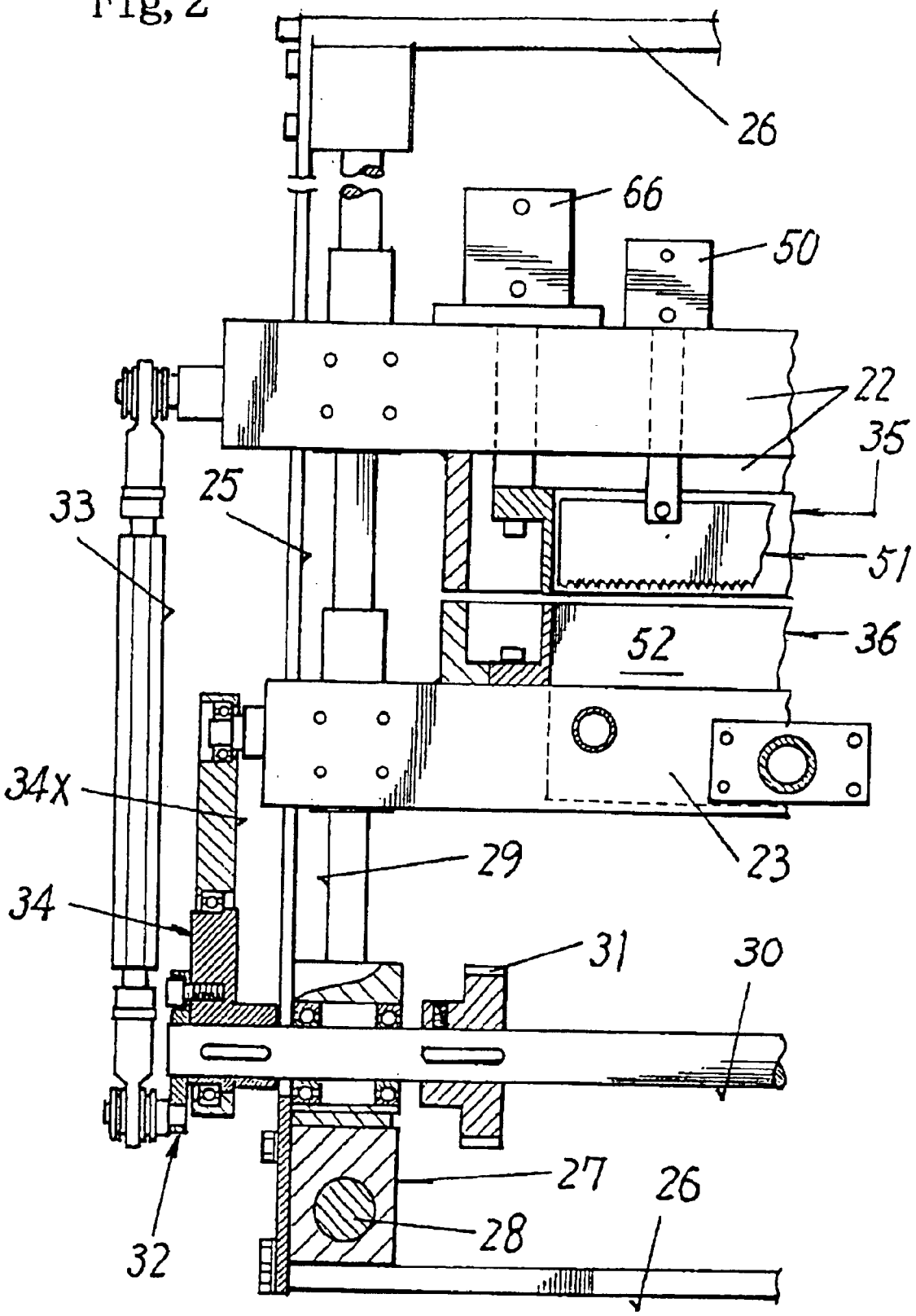

Fig, 3
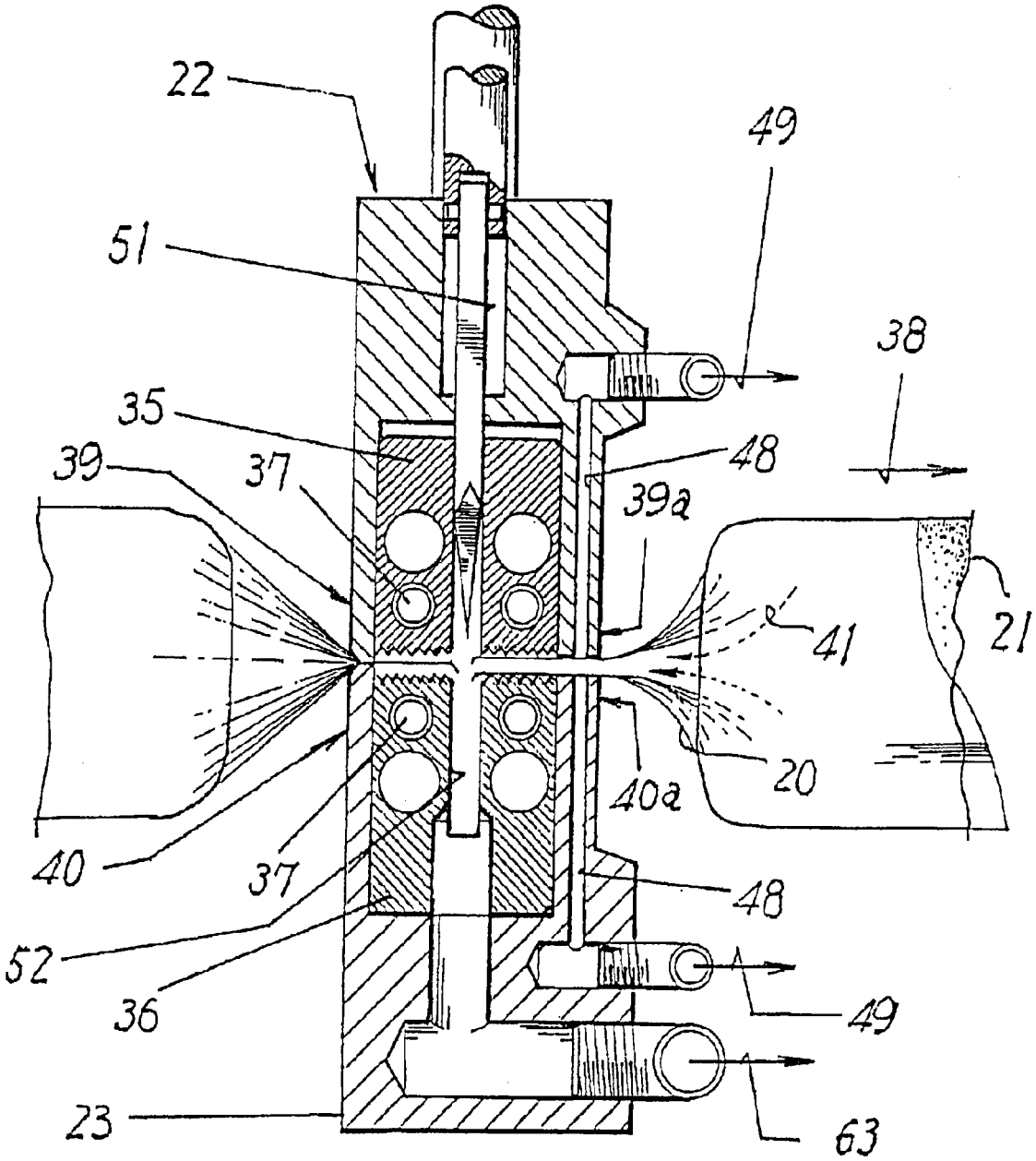

Fig, 5
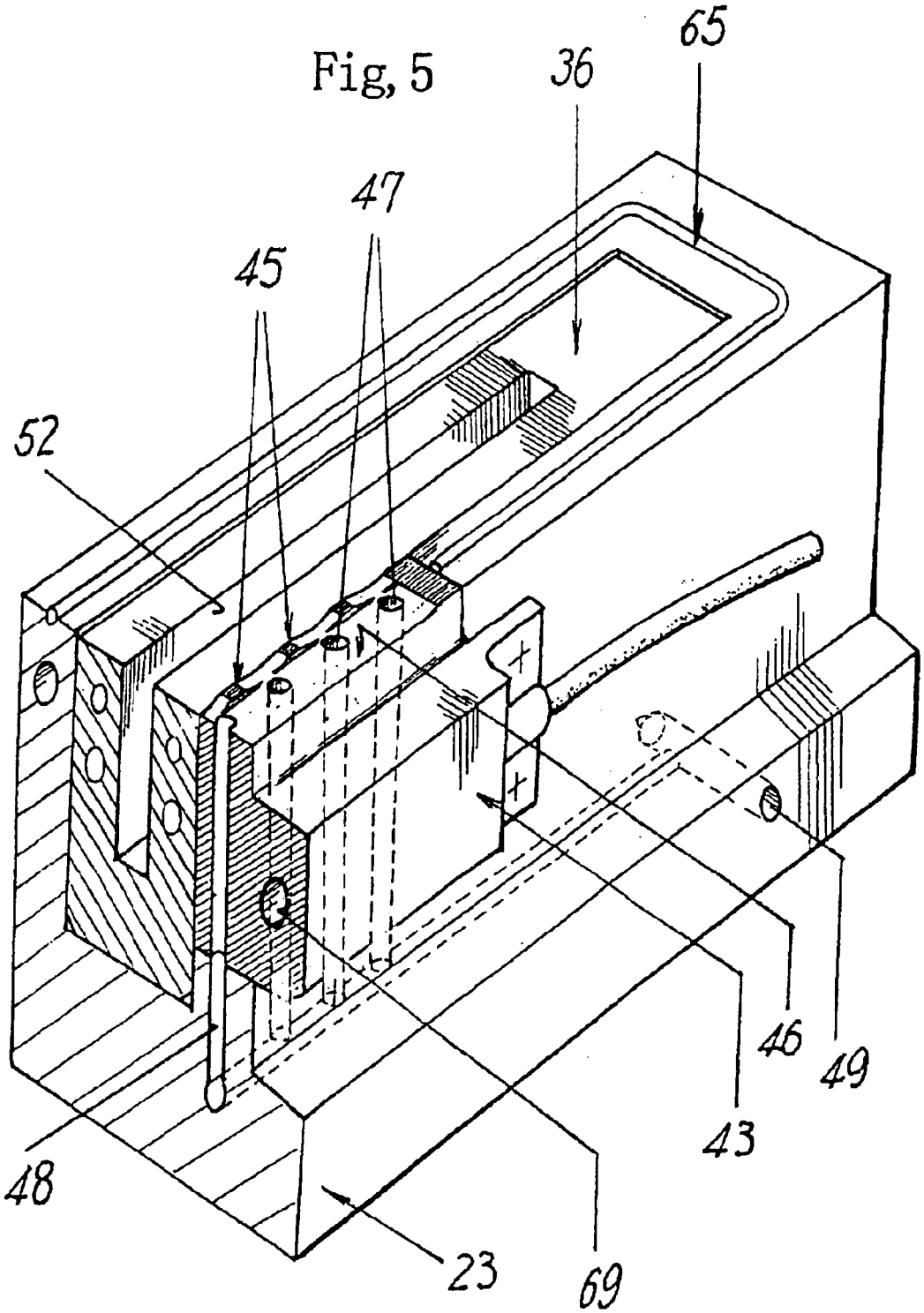

Fig, 6
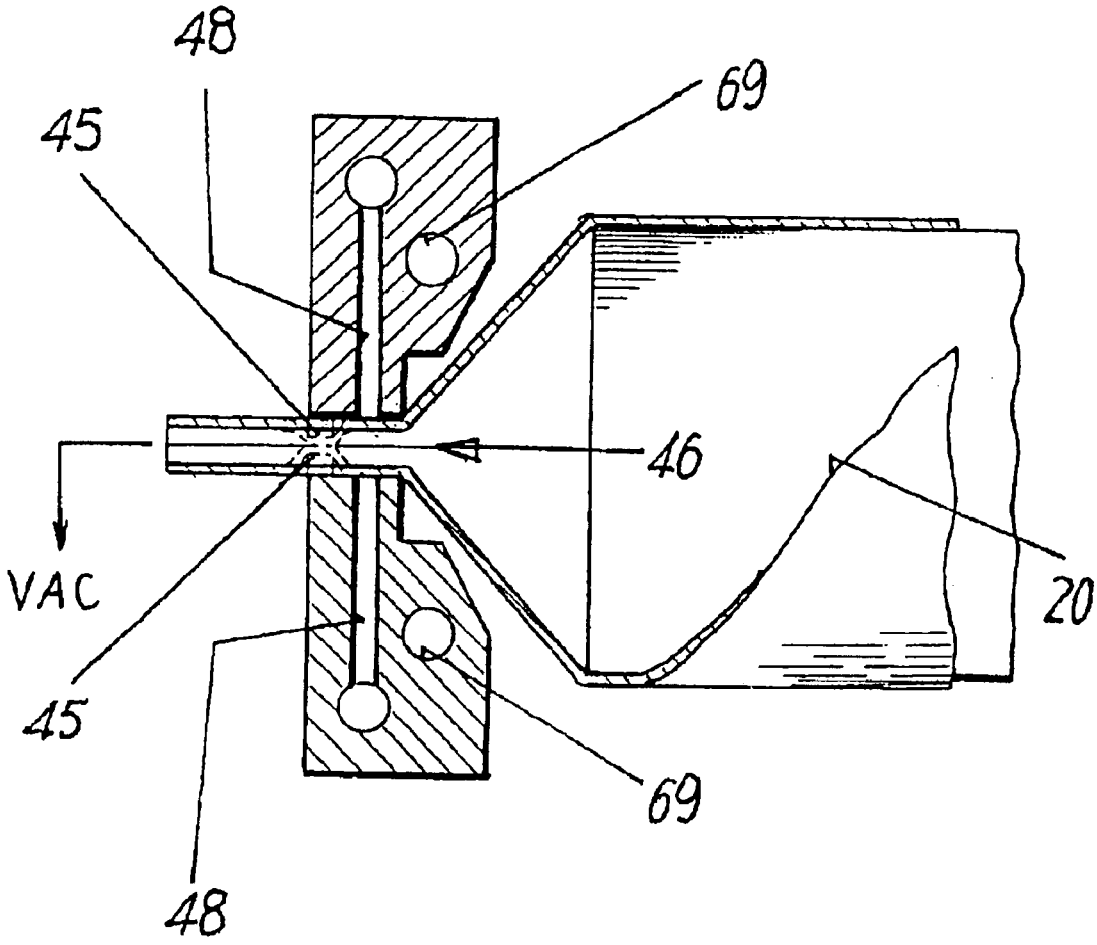

Fig, 7
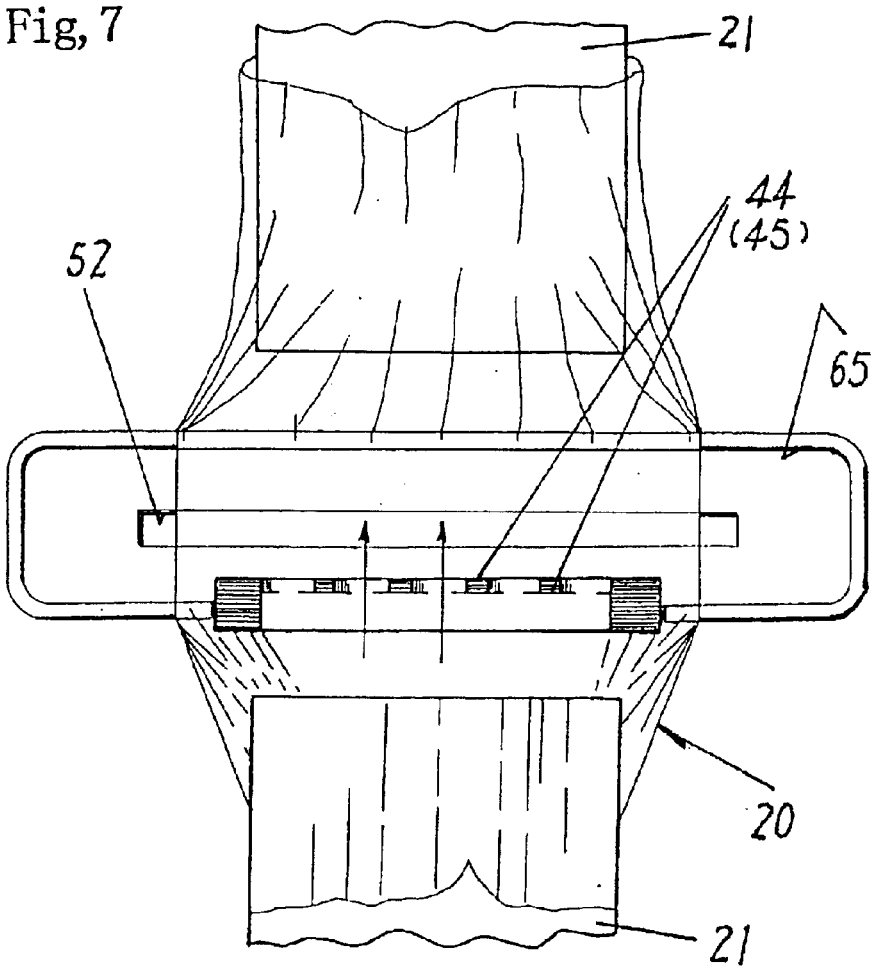
Fig, 8
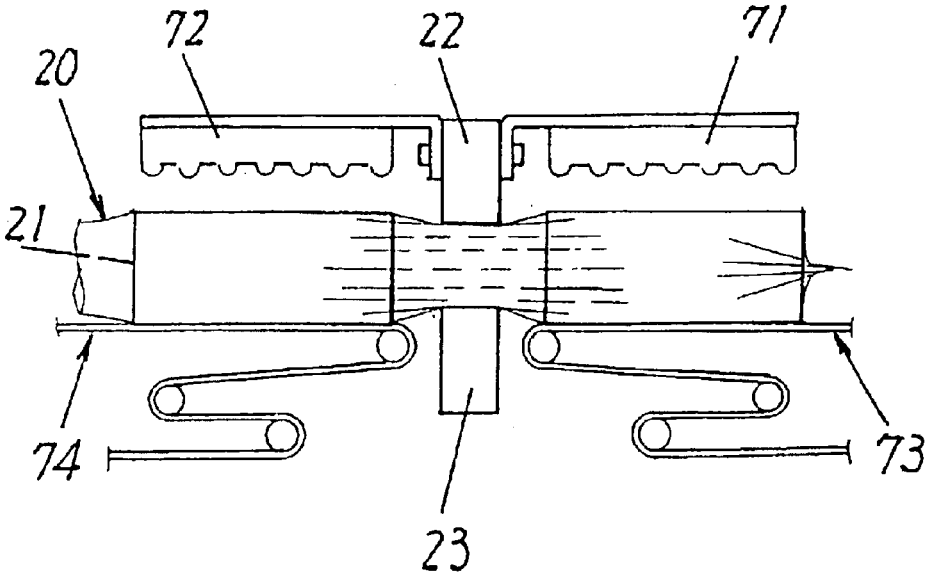

APPARATUS FOR CONTINUOUSLY FORMING VACUUM PACKAGED BODY

REFERENCE TO RELATED APPLICATION

This application is a division of U.S. patent application Ser. No. 10/034,102, filed on Dec. 27, 2001, now abandoned.

FIELD OF THE INVENTION

This invention relates to an apparatus for sequentially isolating and sealing a tube film storing a number of materials to be packaged at equal spaces in a column and moving between the respective materials to be packaged and simultaneously evacuating the interior of the tube film to continuously form a vacuum packaged body.

BACKGROUND OF THE INVENTION

U.S. Pat. No. 4,601,159 discloses the technology where a longitudinally moving tube film is perpendicularly nipped by a pair of seal bars, and immediately before the respective materials to be packaged in the tube film are isolated and sealed, the tube film is cut by cutting edges incorporated in the seal bars, and the air in the tube film is removed through the cut portion to form a continuous vacuum packaged body.

The details of technology disclosed in the above specification are such that the tube film is cut between the front and rear materials to be packaged, the cut end parts are sucked to the dome-like wall inner surface to be largely opened, and the air in the tube film is removed from the opening parts. The positive opening of the cut end part is intended for heightening the efficiency of removing the air in the tube film, but unsuppressed opening for the tube film in the apparatus has high possibility of causing distortion at the open end part, so that even if the open edge is sealed by heat, the above distortion impairs air tightness of the sealed part to exert bad influence upon the sealing performance of the vacuum packaged body. Consequently, the above apparatus is adapted to cut a film opening part and remove the same, and heat-seal two new opposite cut ends of both sides of the removed part, resulting in the disadvantage of causing lowering of efficiency due to the waste of a film in cutting and removing the film and the complicatedness of operation process.

DISCLOSURE OF THE INVENTION

It is an object of the invention to heighten the packaging efficiency by restraining distortion of a film cut part due to air vibration and performing high airtight sealing without distortion for the cut part to prevent wasteful removal of the film due to distortion in the case of cutting a tube film, and removing the air in the tube film by suction action from the cut part.

The object of the invention is achieved by providing a packaging apparatus including a seal bar and a seal table for sealing a tube film in the direction right-angled to the direction of a track disposed in the midway of the track for transferring the tube film storing materials to be packaged at equal spaces in a column along the longitudinal direction, the apparatus being formed by:

I) a pair of seal blocks supporting the seal bar and the seal table outside the opposite surfaces of the seal bar and the seal table by the skirt parts thereof and supporting the same, II) means for spot closing the tube film by plural intermittent teeth at the inner sides of the skirt parts as one points in the transfer direction of materials to be packaged while the respective skirt part edges of both seal blocks nip the tube film corresponding to the pitch transfer of the materials to be packaged, III) a sub-vacuum line for applying vacuum suction force to each port formed on the faces of a standing gap to flare the tube film at the standing gap formed thin formed along the outside of the intermittent teeth, IV) a main vacuum line for pushing a cutting edge slidably disposed in the middle of the interior of the seal bar into a receiving groove cut in the seal table to cut the tube film in the area surrounded by the skirt parts and sucking the air in the bag in front of the seal blocks through the spot nipping gap from between the seal bars and the seal table through the receiving groove in the seal table, and V) means for welding the cut sides of the tube film by relative approach of the seal bar and the seal table after the above removal of air.

According to the invention, every time the respective materials to be packaged are moved by one pitch, the tube film for covering the materials to be packaged is nipped by the skirt part edges of the paired seal blocks. In this case, the plural intermittent teeth formed on the front side of the skirt parts as one points in the transfer direction of the material to be packaged spot close the tube film, and the vacuum suction force of the sub-vacuum line is applied to each port formed on the standing gap formed thin along the front side of the intermittent teeth to flare the tube film, so that the tube film forms a nipping gap between the respective intermittent teeth. The cutting edge provided on the seal bar installed in one seal block is forced into the receiving groove of the seal table in the other seal block to cut the tube film in the area surrounded by the skirt parts, and the air in the bag in front of the seal blocks is sucked through the spot closing gap from between the seal bar and the seal table into the main suction line through the receiving groove in the seal table.

The tube film is thus flared by the sub-vacuum suction force to stick the tube film to the faces of the thin standing gap, and the air in the tube film is removed through the spot gap between the respective intermittent teeth, whereby the vibration of the tube film due to the removed air impact is restrained to prevent the film from being distorted, and the above inhibition of distortion eliminates cut-down of the film so as to prevent waste of the film.

In one preferred embodiment of the invention, the sub-vacuum line and the main vacuum line are connected to a vacuum pump through a vacuum tank. The intermittent removal of air in the tube film corresponding to the pitch transfer of the material to be packaged is performed impulsively by pressure accumulation function of the vacuum tank so that the capability is not lowered.

In another preferred embodiment of the invention, cooling water is passed through the intermittent teeth formed by the skirt parts of the seal blocks to be cooled. In the case of spot nipping the film by the thus constructed intermittent teeth, there is possibility that dot-like cheloid is generated in the film by heat of the tips of the intermittent teeth conducted from the seal bar to spoil the beauty of sealing and sealing strength. Such problem is solved by the above cooling.

In still another embodiment of the invention, simultaneously with nipping the tube film by both seal blocks, the material to be packaged in front of the seal blocks is pressed and supported by a block made of urethane foam. Through the shrinkage of the tube film due to removal of air through the spot gaps between the respective intermittent teeth causes the material to be packaged to necessarily move, the material to be packaged is softly pressed and supported by the block made of urethane foam so that the shrinkage of the film more than needed is inhibited to restrain the generation of creases of the film and perform beautiful sealing. Thus, sealing strength can be increased.

BRIEF DESCRIPTION OF THE DRAWINGS

FIG. 1 is a schematic side view of an apparatus according to the invention;

FIG. 2 is a partial front view of a frame supporting a seal block;

FIG. 3 is a sectional view of a pair of movable blocks;

FIG. 4 is a partial front view of a seal block;

FIG. 5 is a perspective view showing the cut surface of the seal block;

FIG. 6 is a diagram for explaining the packaged body nip part of a pair of seal blocks;

FIG. 7 is a plan view showing the sealed part of the packaged body; and

FIG. 8 is a side view of a tube film transport track.

PREFERRED EMBODIMENTS

A tube film 20 in FIG. 1 is formed by rolling a belt-like film in a bag form-fill-sealing machine, and simultaneously a number of materials 21 to be packaged are stored at equal spaces in the interior thereof. While a pair of upper and lower seal blocks 22, 23 installed in the same packaging machine respectively displace along a dotted-line track 24 according to the transfer in the direction of an arrow of the above materials 21 to be packaged, they nip the tube film 21 between the materials 21 to be packaged to perform air suction and heat sealing action in the film. The constitution of the present embodiment will be described in the following.

FIG. 2 shows the about left half of a frame structure supporting the above paired seal blocks 22, 23, and also in the right area not illustrated, the same structure symmetrical to the drawing continuously exists. That is, the above structure is so constructed that the upper and lower side of a pair of side plates 25 on both sides are connected by tie materials 26 to form a portal frame. Slide blocks 27 respectively fixed to the lower parts of the side plates 25 on both sides are slidably supported on a pair of horizontal guide rods 28, and both ends of the above both movable blocks 22, 23 are slidably supported on round post materials 29 respectively erected on both slide blocks 27. On the other hand, the portal frame is reciprocated along the guide rods 28 by a crank mechanism not shown.

On the other hand, the rotation power transmitted from the outside to a pinion 31 of a main shaft 30 rotatably installed on the frame vertically moves the upper seal block 22 along the round post material 29 through a crank lever 32 and a connecting rod 33 fixed to the end of the main shaft 30, and the lower seal block 23 is vertically moved along the round post material 29 by the eccentric motion of a rod 34*x* tied round an eccentric cam 34 at the end of the main shaft 30. Accordingly, both movable blocks 22, 23 repeatedly execute movement along the dotted line track 24 of FIG. 1.

FIG. 3 shows the condition where the tube film 20 between the front and rear materials 21 to be packaged is nipped by the upper and lower seal blocks, and the upper seal block 22 is provided with a seal bar 35 mounted in a skirt part 39 continuously formed on the lower side thereof, the lower seal block 23 is provided with a seal table 36 mounted in a reverse skirt part 40 formed on the upper surface of the seal block 23, and the seal bar 35 and the seal block 36 respectively contain a pipe heater 37 for generating film welding heat.

The front sides 39*a*, 40*a* of the respective skirt parts of the above both seal blocks in the transfer direction 38 of the material 21 to be packaged form a standing gap ranging from 1 mm to 2 mm between the opposite edges, the air 41 in the front tube film 20 can be circulated through the standing gap, and an embodiment of forming means for such a gap is shown in the drawings mentioned later.

That is, FIG. 4 shows the front faces of the central parts of both seal blocks 22, 23, and FIG. 5 shows the perspective section of the lower seal block 23. A pair of attached blocks 42, 43 embedded in the above both seal blocks 22, 23 and fixed opposite to each other have plural intermittent teeth 44, 45 fastened upon the tube film at the inner edges thereof, a continuous standing gap 46 is formed between the outer edges of the intermittent teeth, and plural ports 47 formed on the upper and lower sides of the standing gap are connected to a sub-vacuum line 49 through passages 48.

It is apparent from FIG. 6 of an enlarged scale that by vacuum suction of the upper and lower passages 48, the tube film 20 is sucked to the upper and lower surfaces of the standing gap 46 ranging from 1 mm to 2 mm and forced open. In this case, the upper and lower intermittent teeth 45 spot close the tube film 20 to limit random expansion, thereby preventing occurrence of distortion in the tube film. In this case, cooling water flowing through a drain passage 69 penetrating the attached blocks in the lateral direction prevents heat transfer from the seal bar or the seal table to the intermittent teeth 69.

In FIG. 2, a first fluid cylinder 50 fixed to the upper seal block 22 vertically slides a cutting edge 51 mounted in the seal bar 35 and forces the cutting edge 51 into the receiving groove 52 of the seal table 36 in the lower area, thereby cutting the tube film. Such a condition is known from FIG. 3 in which when the cutting edge 51 is forced into the lower receiving groove 52 to cut the tube film, the air in the tube film 20 at the front is drawn out into the main vacuum line 53 through the above receiving groove 52.

As shown in FIG. 1, the described sub-vacuum line 49 is connected to a vacuum tank 61 of designated capacity connected to a vacuum pump 60 through a normally-closed first opening and closing valve 62, and the described main vacuum line 63 is connected to the vacuum tank 61 through normally-closed second opening and closing valve 64. The upper and lower movable blocks 22, 23 completely nip the tube film 20, and simultaneously when the vacuum pressure is applied to the sub-vacuum line 49 by opening the first opening and closing valve 62, the tube film is sucked to the upper and lower surfaces of the standing gap 46 in FIG. 4. In this case, a packing 65 mounted on the upper surface of the seal block 23 in FIG. 5 surrounds the receiving groove 52 formed in the seal table as shown in FIG. 7, and the air in the tube film opened by cutting operation of the cutting edge is passed between the respective spot nipping parts 44 and drawn out toward the tank 61 simultaneously with opening of the second opening and closing valve 64 in FIG. 1. The suction in this case is impulsively performed by the capacity action of the vacuum tank 61, and subsequently, the seal bar 35 moved downward by a second fluid cylinder 66 in FIG. 2 is pressed to the seal table 36 to seal the opening part of the tube film.

As shown in FIG. 8, the upper seal block 22 is provided with soft pressing blocks 71, 72 made of urethane foam and fixed to the front and rear thereof. The tube film 20 is nipped by the relative approach of both upper and lower seal blocks 22, 23 and when the air in the tube film 20 is sucked, the pressing blocks 71, 72 press the material 21 to be packaged to the lower belt conveyers 73, 74 thereby inhibiting the shrinkage of the tube film caused by the described vacuum suction to the utmost.

What is claimed is:

1. A sealing apparatus, comprising:

a pair of upper and lower seal blocks (22, 23) located across a transfer track of a tube file (20) accommodating materials (21) at equal spaces, for clamping the tube film between the materials;

a pair of seal bars (35) provided inside skirt parts (39) of the seal blocks (22, 23);

a cutting edge (51) attached to one of the seal bars (35);

an edge receiving groove (52) formed in the other of the seal bars, for receiving the cutting edge to cut the tube film (20); and narrow continuous standing gaps (46) formed in part of a space between opposite edges of the respective skirt parts, whereby air in a front tube film in a transfer direction of the film is evacuated to the outside of the seal block through the edge receiving groove (52), wherein (a) each of the narrow continuous standing gaps (46) formed by cutting the opposite edges of the respective skirt parts comprises a pair of upper and lower teeth (44, 45) opposing to each other, and one of a plurality of parallel air passage portions formed between the respective adjacent pairs of teeth, while a plurality of ports (47) respectively formed on opposite sides of the narrow continuous standing gaps (46) are connected to a vacuum tank (61) having a vacuum pump (60) as a vacuum source thereof, via a sub-vacuum line (49), and a first opening and closing valve (62) is provided in the sub-vacuum line (49) and a second opening and closing valve (64) is provided in a main vacuum line (63), (b) when the pair of seal blocks clamp the tube film and the cutting edge cuts the tube film, substantially simultaneously the first opening and closing valve is opened to separate apart upper and lower faces of the cut portion of the tube film alone the narrow continuous standing gaps by means of vacuum suction force acting on the sub-vacuum line, and intermittent air holes for evacuating air from the tube film are formed in the tube film along the parallel air passage portions by the separating action, and (c) the second opening and closing valve is opened slightly later than the opening of the first opening and closing valve, and air inside the front film to be evacuated to the outside of the seal block through the cutting edge receiving groove is sucked through the main-vacuum line connecting the seal block and the vacuum tank.

2. The apparatus according to claim 1, wherein a cooling water drain passage is formed in a pair of attached blocks formed with the narrow continuous standing gaps and are embedded in the opposite edges of the skirt parts by cutting the opposite edges of the skirt parts.

* * * * *